US006308634B1

(12) United States Patent
Fong

(10) Patent No.: US 6,308,634 B1
(45) Date of Patent: Oct. 30, 2001

(54) PRECURSOR-FOLLOW THROUGH EXPLOSIVELY FORMED PENETRATOR ASSEMBLY

(75) Inventor: Richard Fong, Rockaway, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/651,228

(22) Filed: Aug. 17, 2000

(51) Int. Cl.[7] ..... F42B 12/10
(52) U.S. Cl. ..... 102/476; 102/307
(58) Field of Search ..... 102/306–310, 102/476

(56) References Cited

U.S. PATENT DOCUMENTS 2,796,833 * 6/1957 Sweetman ..... 102/306
4,841,864 * 6/1989 Grace ..... 102/476
5,033,387 * 7/1991 Lips ..... 102/476
5,155,297 * 10/1992 Lindstadt et al. ..... 102/476
5,753,850 * 5/1998 Chawla et al. ..... 102/476
5,792,980 * 8/1998 Weimann ..... 102/476

* cited by examiner

*Primary Examiner*—Harold J. Tudor
(74) *Attorney, Agent, or Firm*—John F. Moran; Michael C. Sachs

(57) ABSTRACT

The precursor-follow through kinetic energy explosively formed penetrator assembly greatly enhances target penetration. It is formed of two sections: an initial precursor penetrator followed by a penetrator encapsulating a reactive material. The target will initially be perforated by the precursor penetrator with the second follow through penetrator containing a reactive material causing internal damage through a secondary reaction.

7 Claims, 3 Drawing Sheets

PRECURSOR-FOLLOW THROUGH EXPLOSIVELY FORMED PENETRATOR ASSEMBLY

CROSS-REFERENCE TO RELATED APPLICATIONS

This application is related to U.S. patent application, Ser. No. 09/641,957 entitled "Segmented Kinetic Energy Explosively Formed Penetrator Assembly", by Richard Fong, filed on Aug. 21, 2000, and which is incorporated herein by reference in its entirety.

GOVERNMENTAL INTEREST

The invention described herein may be manufactured and used by or for the Government of the United States for governmental purposes.

FIELD OF THE INVENTION

This invention generally relates to the field of ballistics, and it particularly relates to explosively formed projectiles (EFP). More specifically, this invention relates to a precursor-follow through kinetic energy explosively formed penetrator, to achieve greater penetration.

BACKGROUND OF THE INVENTION

The concept of using explosive energy to deform a metal plate into a coherent penetrator while simultaneously accelerating it to extremely high velocities offers a unique method of employing a kinetic energy penetrator without the use of a large gun. A typical explosively formed projectile (EFP) is comprised of a metallic liner, a case, an explosive section, and an initiation train. Very often there is also a retaining ring to position and hold the liner-explosive subassembly in place. EFP warheads are normally designed to produce a single massive, high velocity penetrator. After detonation, the explosive products create enormous pressures that accelerate the liner while simultaneously reshaping it into a rod or some other desired shape. The EFP then hits the target at a high speed, delivering a significantly high mechanical power.

Two major applications have evolved for explosively formed projectiles or warheads, namely, long-standoff sensor-fuzed submunitions and medium-standoff, close-overflight missiles. The former application, which is the more traditional one, requires the formation of a single-piece EFP capable of flying in a stable fashion to the target. This refinement has led to the flared EFP rod and, more recently, to the finned EFP rod designs.

For the medium or short-standoff applications, a new type of EFP was developed. The need for an aerodynamic shape is not necessary for these applications because of the short distance the EFP must travel, hence, the length of the rod was increased and the flared tail was eliminated from the design. In fact, some of these rods are purposely stretched beyond their breaking point and fracture into several pieces resulting in greater total length.

An EFP warhead configuration may be comprised of a steel case, a high-explosive charge, and a metallic liner. Explosively formed penetrator (EFP) warheads have been designed to project a single massive high velocity penetrator to attack the top of armored vehicles. Such armor perforation capability needs further improvement to counter new generations of harder armored vehicles, without resorting to a larger caliber weapon system. In developing a warhead configuration that meets system constraints and also meets performance requirements, several parameters in the warhead configuration must be redesigned to achieve an optimum configuration. Several warhead configurations have been developed to accommodate varying system constraints.

SUMMARY OF THE INVENTION

It is an object of the present invention to satisfactorily address the foregoing need and to form a new a precursor-follow through kinetic energy explosively formed penetrator (EFP) assembly, for greatly enhancing penetration.

The foregoing and other objects and features of the present invention are realized by forming the EFP assembly into two sections: an initial precursor penetrator followed by a penetrator encapsulating a reactive material. This will greatly enhance the lethality of the warhead against certain targets, and particularly targets consisting of multi layers or multi compartments. These targets will initially be perforated by the precursor penetrator with the second follow through penetrator containing a reactive material causing internal damage through a secondary reaction. Potential targets include tanks, light armored vehicles, ships, submarines, ballistic missiles, aircraft and bunkers.

The EFP warhead or assembly of the present invention is comprised of the following major components: a copper liner, a reactive material, an explosive billet or charge, a backplate, an aluminum housing, and a detonator assembly for initiating the explosive billet. When the explosive billet is initiated by the detonator assembly, it causes the liner to be accelerated forward with the outer edges folding forward to form or mold the reactive material in a desired aerodynamic shape. The forward folding penetrator then separates into two sections, a precursor and a follow through penetrator. The precursor impacts and penetrates the target with the follow through penetrator containing a reactive material entering the target and causing a secondary reaction.

BRIEF DESCRIPTION OF THE DRAWINGS

The above and other features of the present invention and the manner of attaining them, will become apparent, and the invention itself will be best understood, by reference to the following description and the accompanying drawings, wherein.

Similar numerals refer to similar elements in the drawings. It should be understood that the sizes of the different components in the figures are not necessarily in exact proportion or to scale, and are shown for visual clarity and for the purpose of explanation.

DETAILED DESCRIPTION OF THE INVENTION

Figure 1:
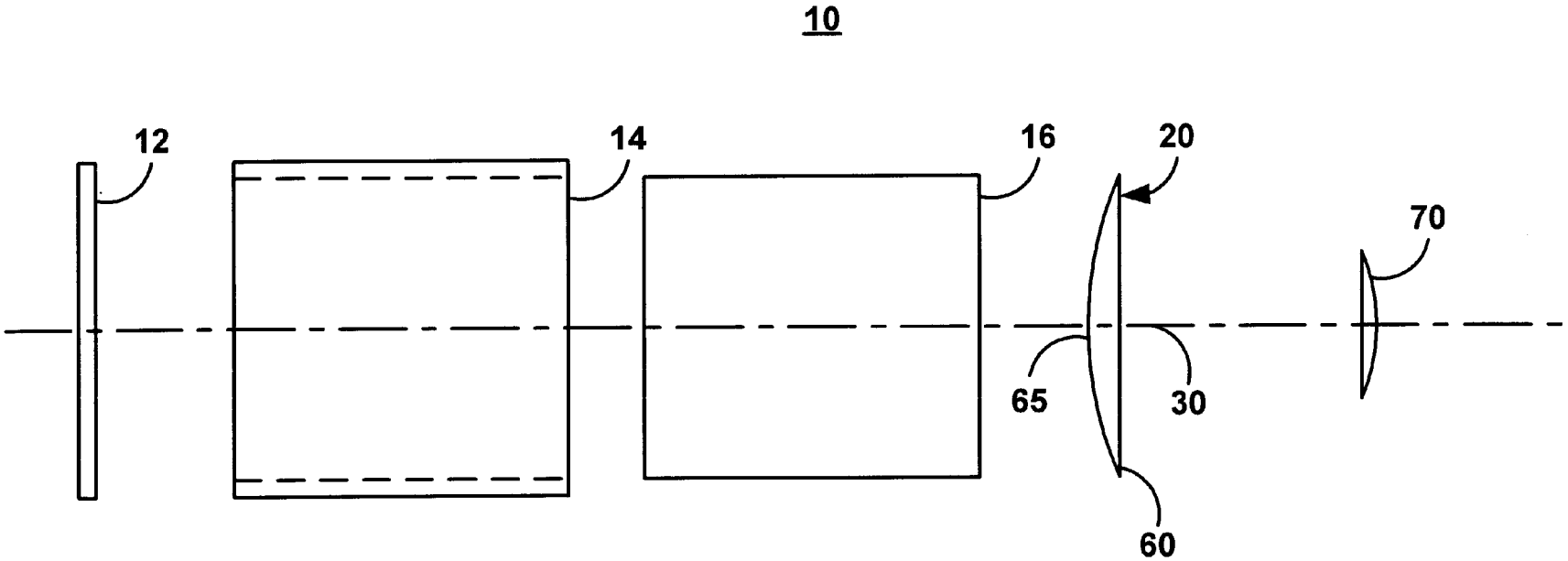
FIG. 1 is a schematic, exploded, cross-sectional, side elevational view of a precursor-follow through kinetic energy explosively formed penetrator (EFP) assembly according to the present invention.
Figure 2:
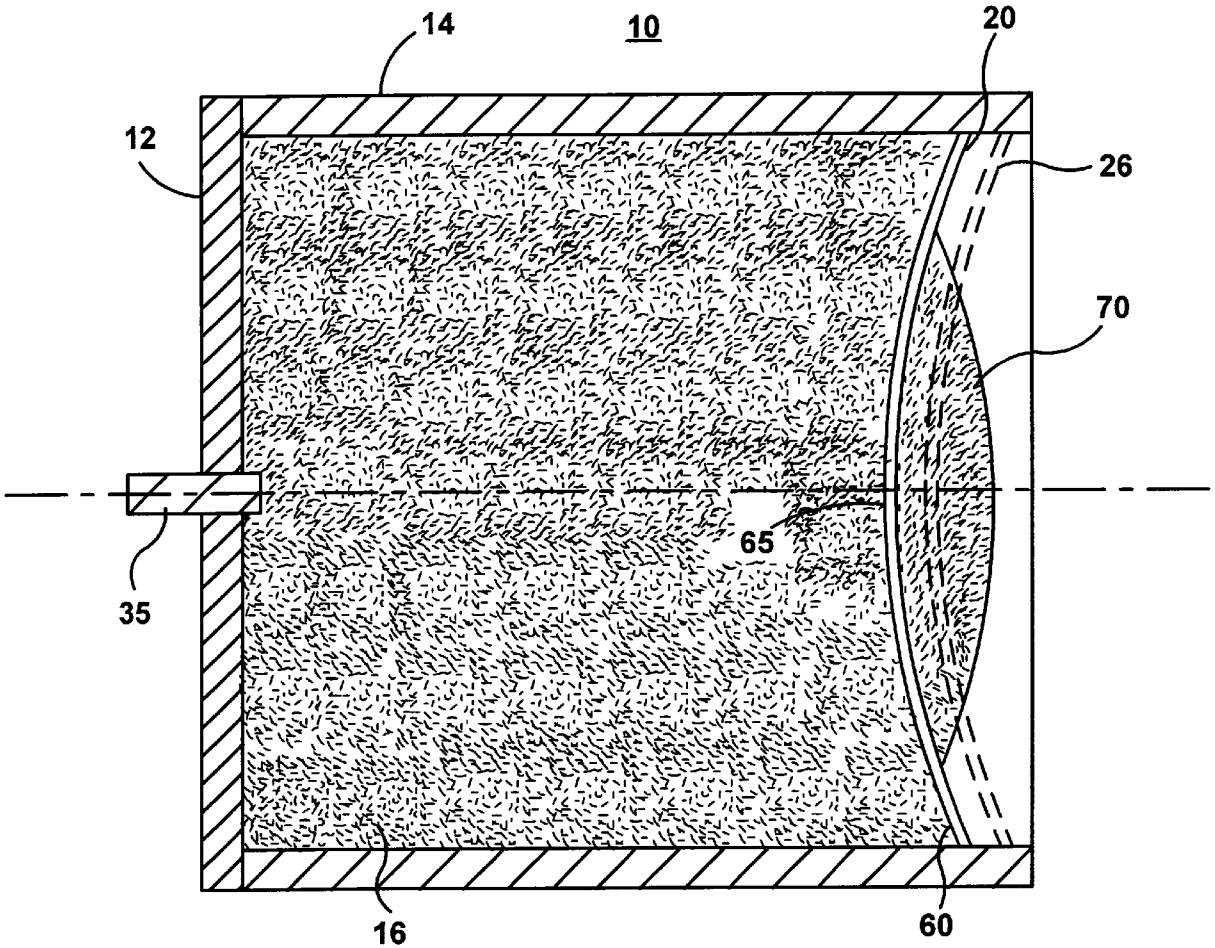
FIG. 2 is a schematic, cross-sectional, side elevational view of the EFP assembly of FIG. 1, shown assembled.

FIGS. 1 and 2 illustrate an exemplary embodiment of a precursor-follow through kinetic energy explosively formed penetrator (EFP) assembly 10 according to the present invention. The EFP assembly 10 generally includes a backplate 12, a housing 14, an explosive billet 16, a liner 20, and a reactive material 70. These components are assembled along a central axis 30.

The backplate 12 and the housing 14 provide a protective casing for the explosive billet 16 and the liner 20. In addition, the mass of the housing 14 provides confinement for the explosive billet 16. The addition of mass around the explosive billet 16 and the liner 20 increases the duration of the explosive impulse and hence the total energy delivered to the liner 20. The material of choice for the backplate 12 and the housing 14 is typically steel because of its relative low cost, high strength, and density. However, other materials, such as aluminum can alternatively be used, as long as the mass is sufficient to provide the necessary confinement.

The density and the physical dimensions of the explosive billet 16 are also of major importance, as they affect the deformation of the liner 20.

With reference to FIGS. 1 and 2, the liner is generally curved and dome (or bell) shaped. The liner 20 has a generally circular peripheral rim or edge 60 and a concave surface 65. The liner 20 is placed inside the housing 14 against the explosive billet 16 such that the concave surface 65 of the liner 20 is curved toward the backplate 12. The rim 60 of the liner 20 abuts against and is secured to the inner surface of the housing 14. The material of choice for the liner 20 is iron, tantalum, copper, or material of like composition, or of metallic materials such as silver, tungsten, or depleted uranium, or of other materials as described herein. The liner 20 might be 0.100 inch thick if of copper, or 0.120 inch thick if of Tantalum.

The reactive material 70 partly fills the liner 20 so that it is formed by the liner 20 into a desired shape, subsequent to firing. The reactive material 70 might be 0.120 inch thick and 1.5 inches in diameter, and made of reactive material such as aluminum or teflon, which upon impact, give a higher burst of energy. The speed of impact could be 2 Kilometers per second if liner 20 was made of Tantalum, or 2.7 Kilometers per second if the liner was made of Copper. A recess may be provided in the housing 14 to receive an additional liner 26, which could be done by machining or other physical alterations. The liners 20 and 26 could be mounted together physically, in the explosive billet's end, by a retaining ring around the liner end of the explosive billet, or even held together by glue or some bonding material, with or without a retaining ring. Although the liners are shown here as tapered, concave shaped, lens-like, they could also in practice be made as disc-shaped, of uniform thickness, with round circumference.

In FIG. 1, section 12 forms a backplate placed flush to a hollow cylindrical housing 14 which has an inside diameter that could be 3 to 6 inches. The cylindrical shaped explosive (billet) 16 could be made of LX-14, OCTOL, or Hand packed C-4, or some other solid explosive, and it can be machined to fit snugly within the inside of the housing, as well as to have a countersunk recess in its forward end, to receive snug placement of a liner or liners, as may be needed. The detonator is physically positioned between back plate 12 and the back end of explosive 16. Ordinarily a shock wave is propagated because of the explosive burning of the billet, in the form of ever expanding hemispheres that are concentric at the detonation point (if there is a single point of detonation). However, with spaced apart, judiciously placed multiple points of detonation, the shock wave front could be more nearly like a plurality of plane waves, propagating straight forward down the housing towards the liner(s), and being nearly plane perpendicular to the central axis of the housing. With plane waves rather than hemispherical type, e.g., it improves the chances to impart as much pressure as possible to the liner(s) to deform and propel same. The detonator could be made of RDX, PETN, RXN, for example, and could be arranged in many detonation configurations, such as by a high voltage detonator into an explosive train, or by a standard Army blasting cap, a line detonator across the back end of the explosive billet, or even plural line detonators that intersect at near equal angles through the center of the back end of the explosive billet. Electrical wires may be run out between the back plate and back end of the explosive billet, if needed. There is a detonation delay of for instance, 15 microseconds, causing perhaps a 5 Kilobar shock wave to propagate down the explosive until it reaches the area of the liner(s). With more powerful explosives or perhaps with multiple simultaneous detonations of the explosive, a 6 Kilobar shock wave might be generated.

Figure 3:
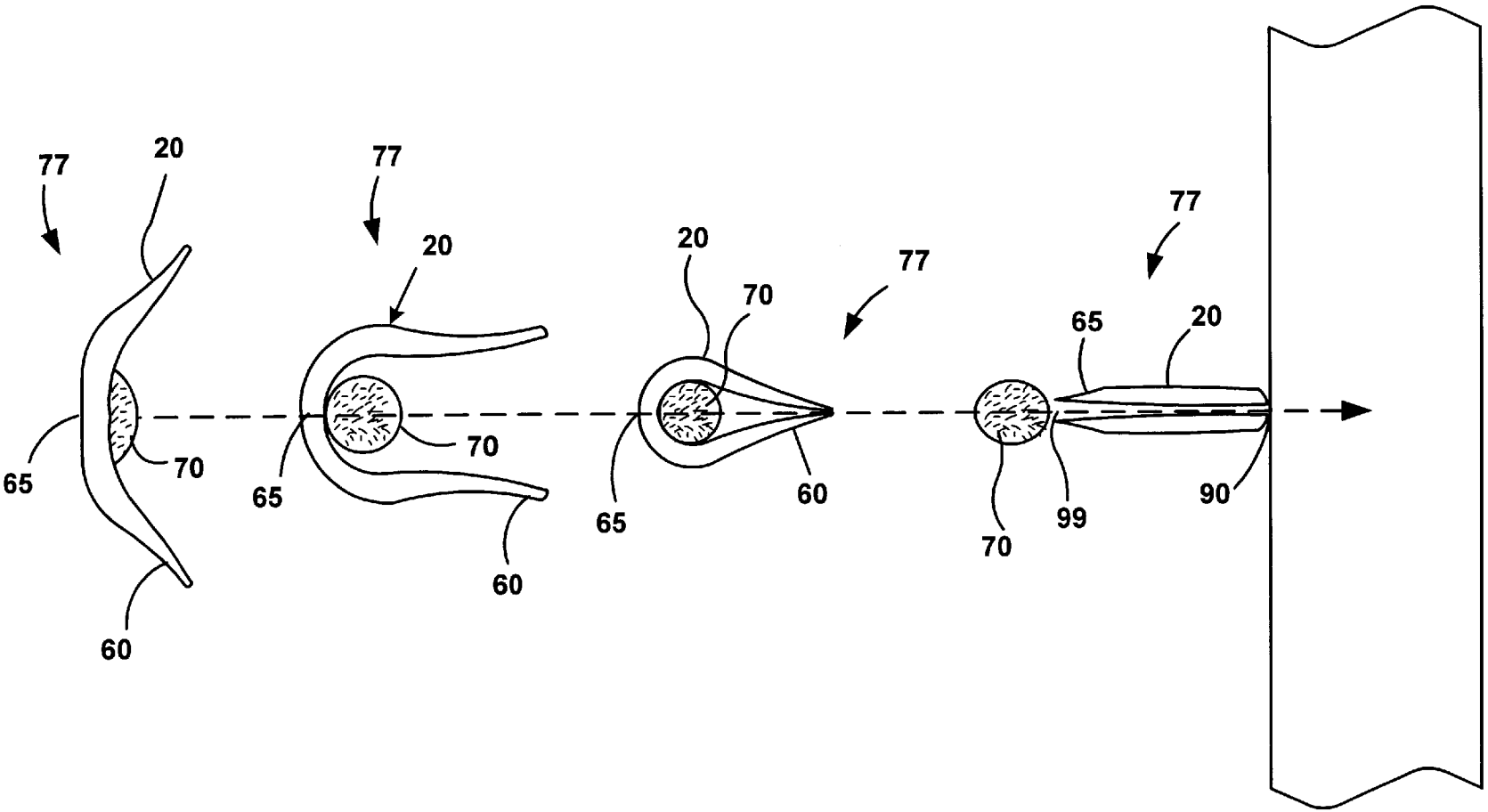
FIG. 3 is a view of a two-stage penetrator that form part of the EFP assembly of FIGS. 1 and 2, shown in flight toward a target, after it has been fired.

With reference to FIG. 3, when the detonator assembly 35 is fired from a gun (not shown), and the detonator assembly 35 initiates the explosive billet 16, the liner 20 is accelerated forward with its outer edges 60 folding forward to form or mold the reactive material 70 in a desired aerodynamic shape. Both the expelled liner 20 and the reactive material 70 enveloped by the liner 20 form a two-stage projectile 77.

During flight, and as it approaches the target, the reactive material 70 perforates the concave surface 65 of the liner 20 and escapes from the liner 20 through a hole 99, separating the projectile 77 into two sections or penetrators: a precursor penetrator 20 (previously the liner 20) and a follow through penetrator 70 (previously the reactive material 70). The precursor penetrator 20 travel along a common trajectory.

As the precursor penetrator 20 reaches and impacts and penetrates the target at impact point 90, and creates a crater therein. The follow through penetrator 70 containing the reactive material enters the target at the crater site and causes a secondary reaction.

In one embodiment, the erosion time of the precursor penetrator 20 is equal to the delay time between the precursor penetrator 20 and the follow through penetrator 70. This delay time can be on the order of milliseconds, but it is a function of several parameters, including velocity, penetrator diameter, length, etc.

It should be understood that the geometry and dimensions of the components described herein may be modified within the scope of the invention and are not intended to be the exclusive; rather, they can be modified within the scope of the invention. Other modifications may be made when implementing the invention for a particular application.

What is claimed is:

1. A kinetic energy, explosively formed penetrator assembly, comprising:

a housing having an inner surface;

an explosive billet disposed within the housing;

a liner disposed against the explosive billet within the housing;

a reactive material disposed within the liner;

wherein the liner is generally concave shaped and includes a peripheral rim;

wherein the peripheral rim of the liner abuts against the inner surface of the housing; and wherein when the liner is expelled from the housing, the peripheral rim of the liner folds forward, causing the liner to envelop the reactive material to form a two-stage penetrator.

2. The penetrator assembly according to claim 1, wherein the two-stage penetrator includes a precursor penetrator formed of the liner, and a follow through penetrator comprised of the reactive material.

3. The penetrator assembly according to claim 1, further including a backplate.

4. The penetrator assembly according to claim 1, further including a detonator assembly that initiates the explosive billet.

5. The penetrator assembly according to claim 1, wherein as the liner folds forwardly, it molds the reactive material in a predetermined aerodynamic shape during flight.

6. The penetrator assembly according to claim 5, wherein after firing, the reactive material perforates the liner and separates from the liner, forming a precursor penetrator and a follow through penetrator.

7. The penetrator assembly according to claim 6, wherein the follow through penetrator causes a secondary reaction after it enters a target.

* * * * *